US006049908A

United States Patent [19]

Bullock et al.

[11] Patent Number: 6,049,908

[45] Date of Patent: Apr. 18, 2000

[54] BREATHABLE BODY WEAR

[76] Inventors: Bradford H. Bullock, 15 Starlight Dr., Norwalk, Conn. 06851; Ronald D. Chelednik, Sr., 45 S. Hope Rd., Jackson, N.J. 08527; Peter J. Mimmo, 102 S. Evergreen Ave., Longport, N.J. 08403

[21] Appl. No.: 09/109,890

[22] Filed: Jul. 6, 1998

[51] Int. Cl.[7] ..... A41B 1/12

[52] U.S. Cl. ..... 2/69; 2/239; 2/81; 2/406

[58] Field of Search ..... 2/69, 82, 87, 312, 2/258, DIG. 1, DIG. 5; 66/190, 196, 202; 428/131, 134, 304.4, 314.2, 316.6, 318.4, 339, 358, 913

[56] References Cited

U.S. PATENT DOCUMENTS

| | | | |
|---|---|---|---|
| 4,195,364 | 4/1980 | Bengtsson et al. | 2/81 |
| 5,124,014 | 6/1992 | Marx et al. | 2/406 |
| 5,483,703 | 1/1996 | Williams | 2/239 |
| 5,551,173 | 9/1996 | Chambers | 36/44 |
| 5,807,295 | 9/1998 | Hutcheon et al. | 602/42 |

*Primary Examiner*—John J. Calvert
*Assistant Examiner*—Robert H. Muromoto, Jr.
*Attorney, Agent, or Firm*—Clifford G. Frayne

[57] ABSTRACT

A breathable body wear garment of multi-layer construction for exercise and sports activities, the garment being constructed of hydrophobic materials and being perforated throughout its surface to encourage the moisture migration of perspiration away from the skin, while at the same time not contributing to the weight of the garment.

8 Claims, 2 Drawing Sheets

BREATHABLE BODY WEAR

BACKGROUND OF THE INVENTION

1. Field of Invention

The present invention relates to clothing, and more specifically, to exercise and sporting garments which are constructed to provide skin abrasion protection and to encourage moisture migration away from the body.

2. Description of the Prior Art

Clothing worn for sports or for exercising has become increasingly more sophisticated. Typical clothing worn during periods of exercise, activity or perspiration producing events typically become saturated with perspiration or moisture which is retained against the skin. This accumulated moisture may affect the exercise program being undertaken, or the sport being played, and may also lead to skin disorders or body odor. The entire surface of the body skin contains sweat glands from which sweat or moisture is expelled. Attempts in the past have generated exercise clothing which emphasizes the migration of moisture away from certain body areas, such as the crotch, to avoid what is commonly referred to as jock itch in men, or possible yeast infections in women. See U.S. Pat. No. 5,390,376 to Marx.

Applicant's garment is designed to allow the migration of moisture away from the body on all parts of the body where the garment is in contact with the skin and in addition to providing this breathability and moisture migration, the garment is constructed of a flexible material of a desired thickness such that the garment itself provides muscle resistance and encourages perspiration and weight loss. Still further, the garment is of such construction that when worn in the performance of a sport, the garment provides abrasion protection to those portions of the body over which the garment is worn.

The garment is further designed so that it can be available in a variety of styles, such as torso and short sleeve, torso only, torso and long sleeve, torso and hips and thigh, full torso legs and arms. As such, a particular style of the garment can be adapted for any form of physical fitness or activity, including aerobics, weight exercises, competitive sports, toning and conditioning, and contact or non-contact sports. The abrasive protection is continuously provided to that portion of the body over which the garment is worn, and the flexibility of the garment continuously provides muscle resistance while the breathability of the garment ensures the migration of moisture and perspiration away from the body so that the exerciser or sports person remains comfortable in performing the activity or sport.

OBJECTS OF THE INVENTION

An object of the present invention is to provide for a novel garment for use in exercise or sport which promotes and encourages the moisture migration of perspiration away from the body during the performance of the exercise or sport.

A further object of the present invention is to provide for a novel garment constructed of a resilient, flexible material which provides muscle resistance to the body in performing an exercise or sport.

A still further object of the present invention is to provide for a novel garment constructed of such material so as to provide abrasive protection to the body portions over which the garment is worn.

A still further object of the present invention is to provide for a novel garment for exercise and sports constructed of laminated material and perforated to provide the desired degree of breathability so as to encourage the moisture migration of perspiration away from the body.

A still further object of the present invention is to provide for a novel garment of multi-layer construction which is hydrophobic and which encourages the moisture migration of perspiration away from the body while at the same time not absorbing such moisture and increasing in weight.

SUMMARY OF THE INVENTION

A breathable body wear garment of multi-layer construction for exercise or sports activities, the multi-layer garment being constructed of hydrophobic materials and being perforated throughout to encourage the moisture migration of perspiration away from the skin while at the same time not contributing to the weight of the garment, the garment being of such thickness so as to provide abrasive protection to those portions of the body over which the garment is worn.

BRIEF DESCRIPTION OF THE DRAWINGS

These and other objects of the present invention will become apparent particularly when taken in light of the following illustrations wherein.

DETAILED DESCRIPTION OF THE DRAWINGS

Figure 1:
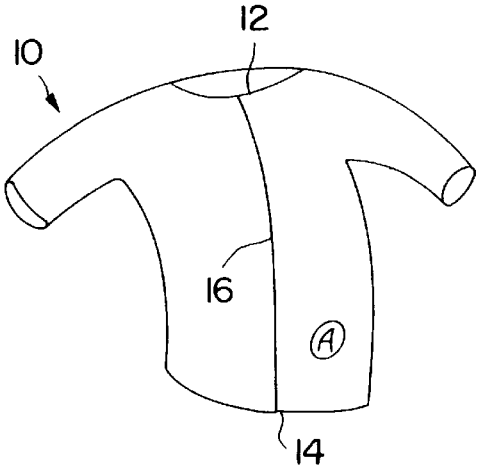
FIG. 1 is a front view of the exercise garment worn by an individual in which the garment is structured to conform and adapt to the shoulders, upper arms, and upper torso of the individual's body.

FIG. 1 is a front view of a breathable exercise garment 10 worn on the torso of an individual. The breathable exercise garment 10 illustrated in this embodiment is a sleeveless garment designed to be worn about the shoulders and upper torso of the individual. The exercise garment 10 in this embodiment is shown with a securable opening 16 in the form of a zipper extending from the neck portion 12 to the waist portion 14. It will be recognized by those of ordinary skill in the art that other fastening means besides a zipper may be used to secure the garment on the torso of the individual. Such a fastening means could include but not be limited to, hook and loop fasteners or the like. The structure of the garment will be explained with respect to FIG. 1, but should be recognized that the same structure of the garment has application to other embodiments of the garment as depicted and illustrated in subsequent Figures to be discussed hereafter.

Figure 2:
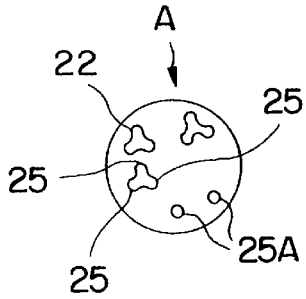
FIG. 2 is a close up view of portion A of the garment as illustrated in FIG. 1.

FIG. 2 is a close up view of portion A of breathable exercise garment 10 as illustrated in FIG. 1. FIG. 2 is further best understood in conjunction with FIG. 3 which is a partial cross-section view of the breathable exercise garment as illustrated in FIG. 1.

The breathable exercise garment 10 is comprised of two or three layers, the first layer 18 being a neoprene layer having an outer surface 17 and inner surface 19. First layer 18 may be 100% neoprene of a mixture of neoprene/polybenzimidazole in the range of 85–100% neoprene 0 to 15% polybenzimidazole. The neoprene/polybenzimidazole layer 18 is the layer of the breathable exercise garment 10 which would be positioned adjacent the skin 24 of the individual in the two layer configuration. The second layer 20 comprises an open knit facing fabric laminated to the neoprene/polybenzimidazole layer and in the preferred embodiment, it has been determined that a LYCRA® fabric has the most desirable qualities of comfort and expandability while being inherently hydrophobic.

Figure 3:
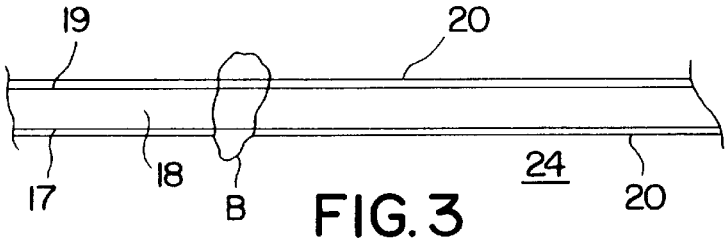
FIG. 3 is a partial cross-sectional view of the garment as illustrated in FIG. 1.

Referring now back to FIG. 2 and close up area A of FIG. 1, the neoprene/polybenzimidazole layer is perforated throughout its entire surface with a plurality of trilobal shaped perforations 22. The trilobal perforations 22 in the neoprene/polybenzimidazole layer are randomly positioned and separated sufficiently so as not to effect nor detract from the durability and expandability and stretchability of the material such that it would result in a tear. The trilobal shape of the perforations allows for the wicking away of moisture from the skin of the individual. Due to the geometric shape of the trilobal perforations which essentially define a triangle with respect to the outer apex 25 of each lobe, there is insured a canal for the gravity feed of perspiration away from the skin surface regardless of the body's motion or the body's position. While the present invention will be described with respect to the trilobal-shaped perforations, for ease of manufacture, circular perforations are also acceptable as illustrated by 25A in FIG. 2. The size or dimension of the trilobal perforations or circular perforations would be in the range of 1/32 of an inch to 1/4 of an inch. Depending on the size of the perforations, the number would vary from 1 to 50 per square inch. The open knit fabric layer 20 comprising a LYCRA® fiber which is laminated on the outer surface of the neoprene/polybenzimidazole layer 18 is essentially hydrophobic and will allow for the moisture which is wicked away or migrating away from the body to pass through without any interference. FIG. 3 also illustrated the embodiment wherein a fabric layer 20, also of LYCRA®, is laminated to the inner surface of garment 10. Its hydrophobic characteristics perform in the same manner whether there is only one layer on the outer surface or an additional layer on the inner surface.

Figure 4:
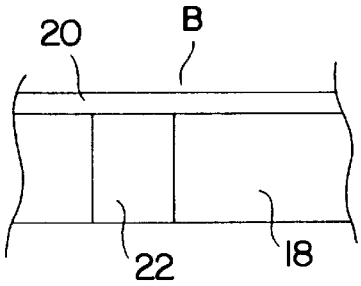
FIG. 4 is a close up cross-sectional view of portion B of the cross-sectional view of FIG. 3.

FIG. 4 is a close up view of area B of FIG. 3 which illustrates the positioning of the trilobal perforation 22 in the neoprene/polybenzimidazole layer 18 in communication with the skin 24 of the individual terminating at the hydrophobic knit fabric LYCRA® layer which is laminated over the neoprene/polybenzimidazole layer on the outer surface.

Figure 5:
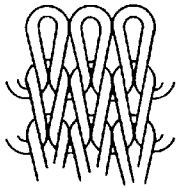
FIG. 5 PRIOR ART
FIG. 5 is a front view of the knit construction of the shell fabric.
Figure 6:
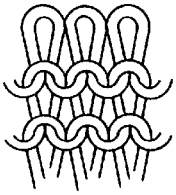
FIG. 6 PRIOR ART
FIG. 6 is a rear view of the construction of the shell fabric.

FIGS. 5 and 6 are a partial front view and a partial rear view of the knit construction utilized in the fabric layer 20 which overlays the neoprene/polybenzimidazole layer. While a variety of knit constructions are possible, the knit construction identified in FIGS. 5 and 6 is commonly referred to as a Jersey knit construction and a shell cover of this type comprised of Lycra fiber and laminated to the neoprene/polybenzimidazole layer will not seal or clog any of the trilobal apertures in layer 18 and will thus allow for the free migration or wicking effect of moisture away from the body of the wearer. In the preferred embodiment of the breathable exercise garment, the thickness of the neoprene/polybenzimidazole layer can vary depending upon the type of garment which is being worn. The types of garment will be discussed hereafter in detail, but it will be recognized by those of ordinary skill in the art that the thickness can vary depending upon the use to which the particular garment is being subjected. In that regard, the neoprene/polybenzimidazole layer 18, could vary in thickness from garment to garment in the range of from 1/32 of an inch to 3/4 of an inch, depending upon the purpose for which the garment is being utilized. For example in a heavy exercise routine, the individual may prefer the thinner neoprene/polybenzimidazole layer 18 since the work out is going to be extended and substantial perspiration is going to be developed and the individual may have a desire to migrate or wick off the perspiration in as quick a manner as possible. At the other extreme, if the individual is wearing the garment in a passive situation wherein the garment itself is providing resistance to the muscle groups and the garment is being used for weight loss during passive exercises such as walking or moving generally about the house, the individual may prefer a thicker neoprene/polybenzimidazole layer 18 to enhance the perspiration process. A still further example, if the individual is wearing the breathable exercise garment in the performance of a sporting activity wherein the abrasive protection characteristics of the garment are desired, then that individual may also prefer a garment wherein the neoprene/polybenzimidazole layer 18 is of the thicker range.

Figures 7A, 7B, 7C, 7D, 7E:
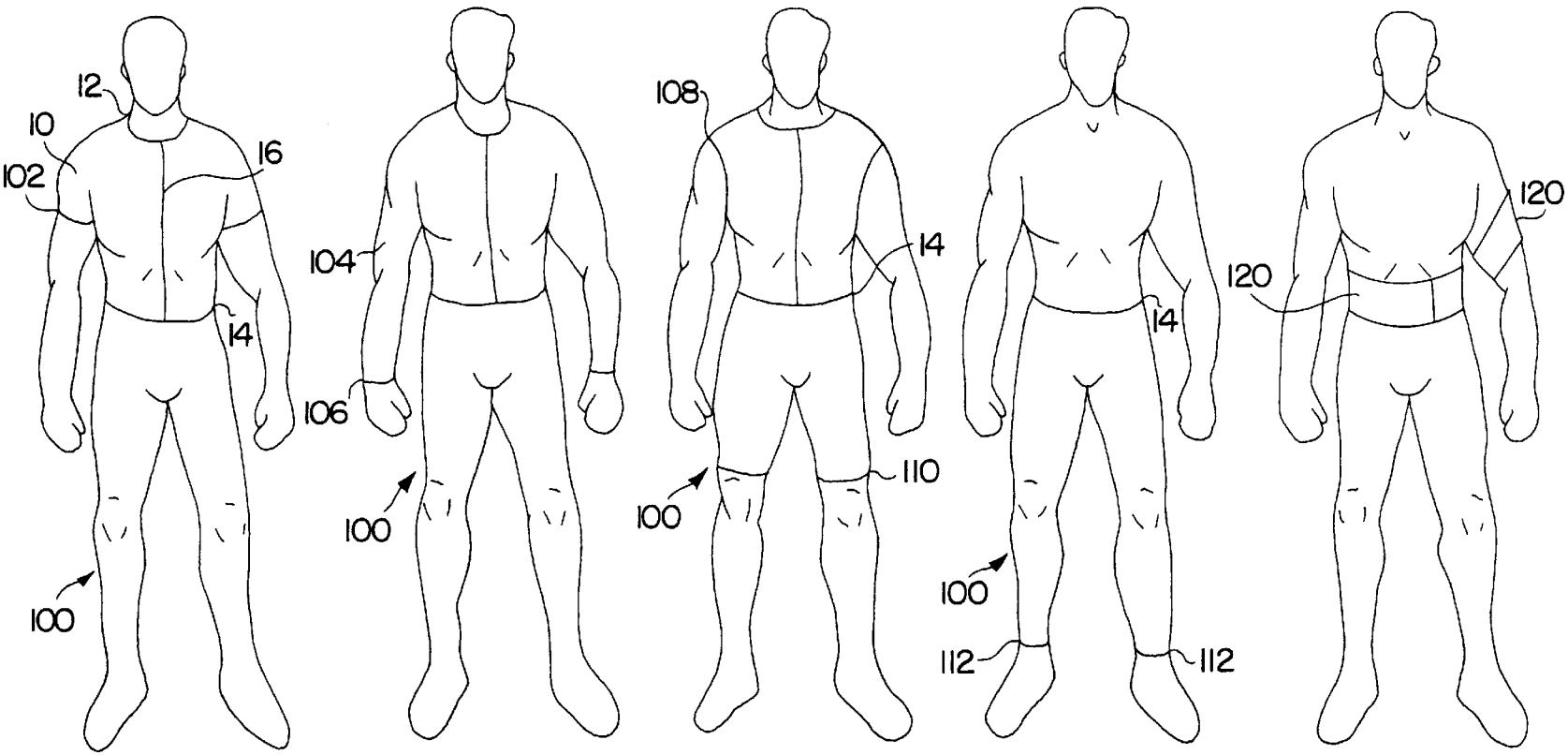
FIG. 7A is an illustration of the garment illustrated in FIG. 1 on the torso of an individual.
FIG. 7B is an alternative embodiment of the garment illustrated in FIG. 1.
FIGS. 7C and 7D are a still further alternative embodiment of the garment illustrated in FIG. 1.
FIG. 7E is a still further embodiment of the garment illustrated in FIG. 1 wherein this illustration depicts or relates to a garment to be worn on a specific limb of the body.

FIG. 7A illustrates the torso of an individual 100 wearing the breathable garment 10 as illustrated in FIG. 1, namely a breathable garment 10 having a neck opening 12, a front opening 16, and a waist portion or waist band 14. In particular, the garment worn as illustrated in FIG. 7A is a short sleeve garment with the breathable garment terminating at the waist and about the upper arm 102. FIG. 7B is an alternative embodiment of the garment 10 worn on torso 100. In this embodiment, the garment is worn about the upper torso but includes long sleeves 104 terminating proximate the wrist 106 of the individual.

FIG. 7C illustrates a further embodiment of the breathable garment on body FIG. 100. In this configuration the upper torso garment is sleeveless, terminating about the shoulders 108 of the individual and extends downwardly to the waist portion 14. Also in this illustration there is disclosed a breathable garment 10 for the lower portion of the individual's body which extends from waist portion 14 to a location 110, slightly above the knees, thereby covering the thighs and buttocks.

FIG. 7D illustrates a still further embodiment of the present breathable garment about body 100. In this configuration, the garment comprises a lower torso garment 111 which extends from the waist portion 14 to the ankles 112 of the individual.

Finally, FIG. 7E illustrates a still further embodiment of the breathable garment of the present subject matter of the application wherein the breathable garment is fashioned into wraps 120 which can be dimensioned and configured to be adapted to certain body portions. As reference to FIG. 7E, wraps are shown about the upper arm portion of the individual or about the waist portion of the individual. These wraps could also be dimensioned and configured to fit about the lower arm portion, upper arm portion, or upper leg portion or lower leg portion of the individual. The purpose of the individual stylized and configured wraps would be to concentrate resistance and hence perspiration on a particular body area.

Still further, it will be recognized by one skilled in the art that the various breathable garments as illustrated in FIGS. 7A through 7E can be used interchangeably or in cooperation with each other. For instance, the upper torso breathable garment illustrated in FIG. 7B could be used in conjunction with the lower torso breathable garment illustrated in FIG. 7D to provide a breathable garment which covers substantially the entire torso and appendages. Still further, the upper body breathable garment of Figure C could be substituted for the full upper torso and appendage breathable garment in FIG. 7D to provide for a breathable garment covering substantially the entire torso and legs, but leaving the arms free.

Still further the individual wraps 120 of the breathable garment can be used in cooperation with the other breathable body garment parts illustrated in FIGS. 7A, B, C, and D.

While the present invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

We claim:

1. A breathable body wear garment comprising:

a hydrophobic main body wear garment adapted to be worn by an individual, said hydrophobic body wear garment having an inside surface and an outside surface, said inside surface resiliently adjacent the skin of the body portion on which is worn;

said hydrophobic main body wear garment having a plurality of apertures extending from said inside surface to said outside surface for the passage therethrough from said inside surface to said outside surface of moisture in the form of perspiration, said plurality of apertures in spaced apart relationship throughout said breathable body wear garment;

a hydrophobic knit fabric layer laminated over said outer surface of said hydrophobic main body wear garment wherein said plurality of apertures in said hydrophobic main body wear garment are distributed on said hydrophobic main body wear garment in a range of from 1 aperture per square inch to 50 apertures per square inch.

2. A breathable body wear garment in accordance with claim 1 wherein a hydrophobic knit fabric layer is laminated over the inside surface of said main body wear garment.

3. The breathable body wear garment in accordance with claim 1 wherein said plurality of apertures between said inside surface and said outside surface are trilobal in cross-sectional configuration for the passages therethrough of moisture from the body of the wearer.

4. The breathable body wear garment in accordance with claim 1 wherein said plurality of apertures between said inside surface and said outside surface of said hydrophobic main body wear garment are circular in cross-sectional area for the passage therethrough of moisture and perspiration from the body of the wearer.

5. The breathable body wear garment in accordance with claim 3 or 4 wherein said plurality of apertures in said hydrophobic main body wear garment from said inside surface to said outside surface are distributed on said hydrophobic main body wear garment in a range of from 1 aperture per square inch to 50 apertures per square inch.

6. The breathable body wear garment in accordance with claim 1 wherein said hydrophobic main body wear garment comprises a thickness in a range of from 1/32 of an inch to 3/4 of an inch.

7. The breathable body wear garment in accordance with claim 6 wherein said hydrophobic main body wear garment comprises a neoprene layer.

8. The breathable body wear garment in accordance with claim 6 wherein said hydrophobic body garment comprises a neoprene/polybenzimidazole layer in a range of 85% to 100% neoprene and 0 to 15% polybenzimidazole.

* * * * *